US006006545A

United States Patent [19]

Tranier

[11] Patent Number: 6,006,545

[45] Date of Patent: Dec. 28, 1999

[54] LIQUEFIER PROCESS

[75] Inventor: Jean-Pierre Tranier, Paris, France

[73] Assignee: L'Air Liquide, Societe Anonyme Pour L'Etude Et L'Exploitation Des Procedes, Paris Cedex, France

[21] Appl. No.: 09/134,309

[22] Filed: Aug. 14, 1998

[51] Int. Cl.[6] ..... F25J 3/00

[52] U.S. Cl. ..... 62/615; 62/640; 62/643; 62/910

[58] Field of Search ..... 62/615, 640, 643, 62/645, 646, 910, 939, 940

[56] References Cited

U.S. PATENT DOCUMENTS 4,705,511 11/1987 Agrawal et al. ..... 62/645
5,123,249 6/1992 Buttle ..... 62/646
5,157,926 10/1992 Guilleminot ..... 62/940
5,303,556 4/1994 Dray et al. ..... 62/939
5,331,818 7/1994 Rathbone ..... 62/646
5,584,194 12/1996 Gardner ..... 62/615
5,802,873 9/1998 Howard ..... 62/646

*Primary Examiner*—Ronald Capossela
*Attorney, Agent, or Firm*—Linda K. Russell

[57] ABSTRACT

A process for liquefying a gas, wherein the gas is compressed, cooled, then expanded in a first turbine and at least partially liquefied, wherein a portion of the liquid produced is also cooled, and then expanded in a second turbine, wherein the second turbine operates with a higher inlet temperature than the first turbine and the first turbine operates at an outlet pressure different than that from the second turbine.

21 Claims, 4 Drawing Sheets

LIQUEFIER PROCESS

FIELD OF THE INVENTION

The invention relates to a process for liquefying a gas stream and to a liquefier.

BACKGROUND

Many processes have been used to liquefy the constituents of air.

U.S. Pat. No. 3,605,422 discloses a process for liquefying nitrogen in which nitrogen from a medium pressure column is compressed by two compressors in series and then divided in three portions. Two of the portions are respectively expanded to the same pressure in a turbine, one portion being expanded in a cold turbine and the other portion being expanded in a warm turbine. The remaining portion is liquefied and sent back to the column.

U.S. Pat. No. 4,778,497 relates to a process in which the nitrogen gas to be liquefied is compressed in two boosters in parallel to the same pressure and divided into three portions, two of which are expanded at different temperatures to the same pressure and one of which is liquefied and expanded in a turbine.

U.S. Pat. No. 4,883,518 discloses a process in which medium pressure nitrogen is compressed by two boosters in series and then divided in two, one part being liquefied and sent back to the column and the other being expanded in a cold turbine and recycled to the booster. A portion of nitrogen not compressed by the boosters is expanded in a warm turbine to the same pressure as that of the outlet of the cold turbine.

U.S. Pat. No. 4,894,076 concerns a more complex process using at least four turbines.

In U.S. Pat. No. 5,231,835, nitrogen is compressed by two boosters in series and sent to a warm turbine. The cold turbine is fed with nitrogen which does not pass to the boosters and produces an expanded nitrogen stream at a lower pressure than that produced by the warm turbine.

This arrangement has the advantage of reducing the pressure ratio across the cold expander in order to keep a good efficiency on this turbine. Nevertheless, this is not the best arrangement in terms of efficiency of the liquefying process.

It is well known in the art that it is always better to have the higher pressure at the inlet of the cold turbine in order to keep a low pressure ratio, which means increasing the outlet pressure of the cold turbine. The problem, presented in U.S. Pat. No. 5,231,835, in which the cold turbine has a high outlet temperature (due to the higher pressure of the cold turbine, which is due to the higher pressure resulting in a higher temperature of the cooled supercritical fluid after heat exchange with the cold turbine outlet) can be solved by incorporating the present invention which relates to the subcooler design.

SUMMARY OF THE INVENTION

According to the invention, there is provided a process for liquefying a gas stream comprising compressing a first gas stream from a first pressure to a second pressure, compressing said first gas stream from said second pressure to a third pressure, dividing said first compressed gas stream at said third pressure into first and second portions, compressing said first portion, cooling said compressed first portion, expanding part of said compressed first portion in a first turbine and at least partially liquefying the rest of said first portion to form an at least partially liquefied fraction, cooling at least part of said second portion and expanding said at least part of said cooled second portion in a second turbine, said second turbine having a higher inlet temperature than said first turbine wherein said first turbine has an outlet pressure different from the outlet pressure of said second turbine.

Another embodiment of the invention provides a liquefier for liquefying a gas stream comprising a heat exchanger, first and second turbines, first compression device, second compression device, third compression device, a conduit for sending said gas stream to said first compression device, a conduit for sending said gas stream from said first compression device to said second compression device, conduits for dividing said gas stream compressed by said second compression device into first and second portions, for sending said first portion to said third compression device and for sending said first portion from said third compression device to said heat exchanger, a conduit for sending part of said first portion from said heat exchanger to said first turbine, a conduit for sending said part of said first portion from said first turbine to said second compression device, a conduit for at least partially liquefying rest of said first portion to form an at least partially liquefied fraction, a conduit for sending at least part of said second portion from said second compression means to said heat exchanger, a conduit for sending said at least part of said second portion from said heat exchanger to said second turbine and a conduit for sending said second portion from said second turbine to said first compression device.

DETAILED DESCRIPTION OF THE INVENTION

Figure 1:
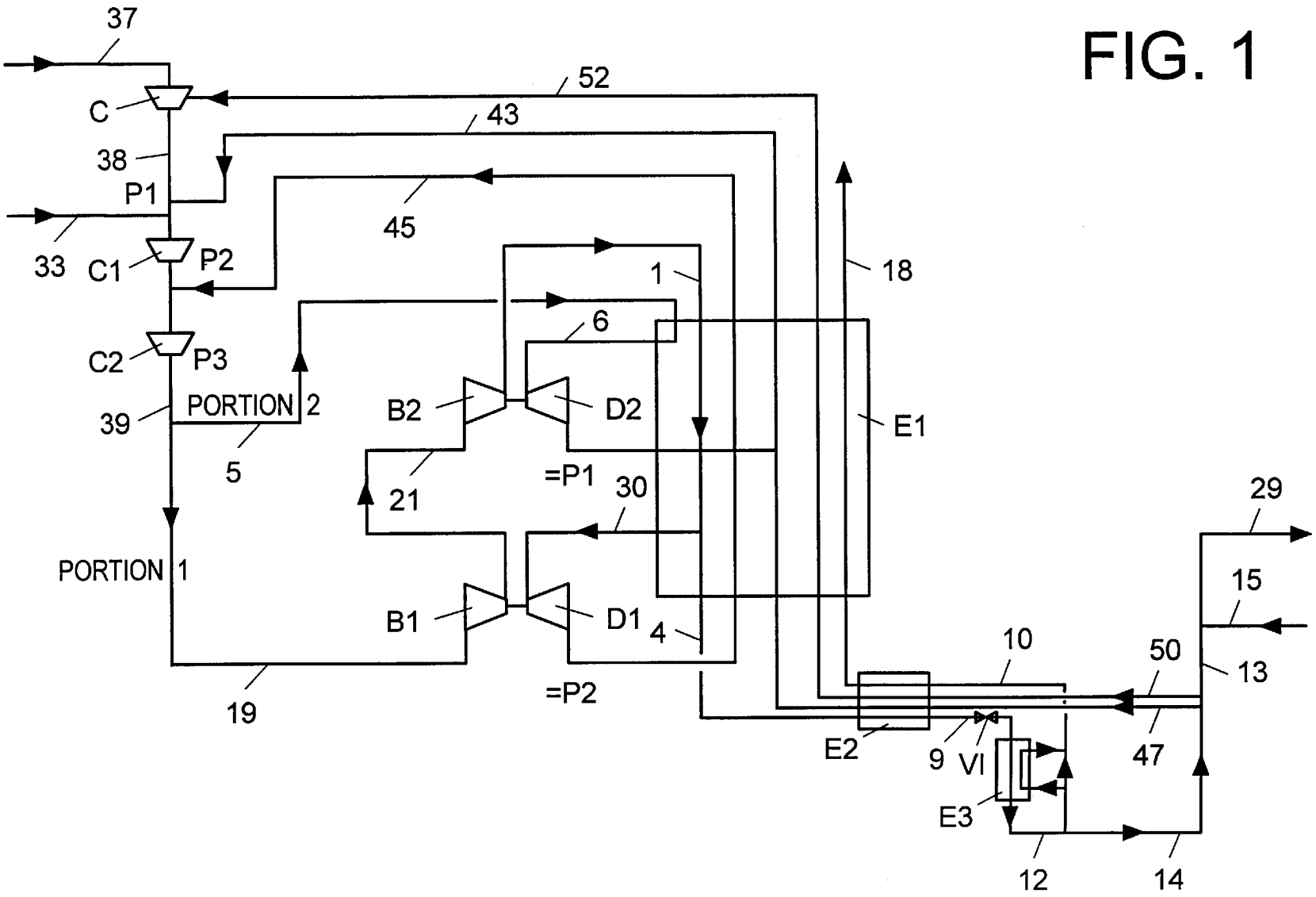
FIG. 1 is a simplified diagram of one embodiment of the invention.

As denoted in FIG. 1, a stream of air is separated in an air distillation unit comprising a double column (not shown) and nitrogen 33 at a first pressure is removed from the medium pressure column of the double column. At the same time a stream 37 of nitrogen at is removed from the low pressure column of the double column; after compression in compressor C this stream 38 is mixed with the nitrogen 33 at the first pressure and a first recycle stream 43.

The stream is then compressed to a second pressure in compressor C1 (first compression means) and is mixed with a second recycle stream 45; is compressed in compressor C2 (second compression means) to a third pressure to form stream 39 and is divided in two.

A first stream 19 is further compressed in boosters B1, B2, is cooled in heat exchanger E1 and is divided in two. Booster B1 is coupled to first turbine D1 and booster B2 is coupled to second turbine D2.

Part 30 of the first stream is expanded by the first turbine D1 to the intermediate pressure, is warmed in the heat exchanger E1 and is mixed with the feed stream upstream of compressor C1 forming the second recycle stream 45. The rest 4 of the first portion is liquefied in heat exchanger E1, sent to heat exchanger E2 where it is cooled, expanded in valve V1, cooled in heat exchanger E3 and divided in two fractions.

The first fraction 14 is divided into three streams 13, 47 and 50, two of which return to heat exchanger E1. Following warming, stream 47 is mixed with the first recycle stream 7 within the heat exchanger E1 and stream 50, 52 is recycled to compressor C and is mixed with the low pressure nitrogen.

The rest 13 of the first fraction is divided into two substreams, one of which 29 is sent back to the air separation unit, the other 15 being sent to a storage tank.

The second fraction is expanded in valve V2 and separated into a gas stream and a liquid stream which is sent back to heat exchanger E3. The two streams are then mixed, sent to heat exchangers E2 and E1 and then vented (streams 10 and 18).

The second portion 5 is slightly cooled, passes through refrigeration unit R where it is cooled and is expanded in second turbine D2. It is then warmed and mixed with the stream 47 and then with feed stream 38 downstream of compressor C1.

Figure 2:
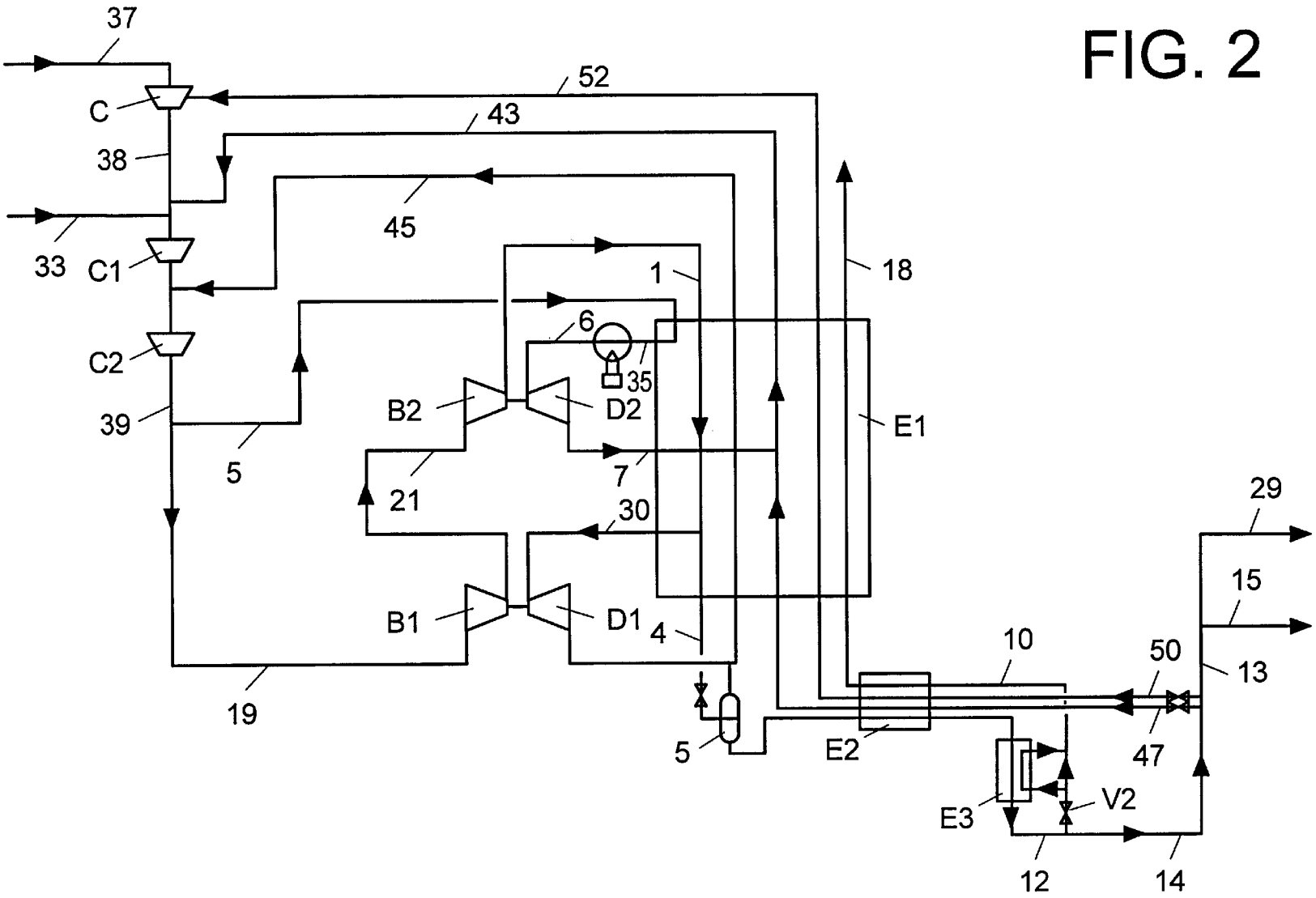
FIG. 2 is an additional embodiment of the invention wherein the feed stream is only partially liquefied.

In FIG. 2, the stream 4 is only partially liquefied by the heat exchange in E1. The dual phase mixture thus formed is sent to separator S; the liquid fraction is treated in the same way as stream 4 of FIG. 1 but the gaseous fraction is mixed with expanded gas from turbine D1 and recycled to compressor C2.

Figure 3:
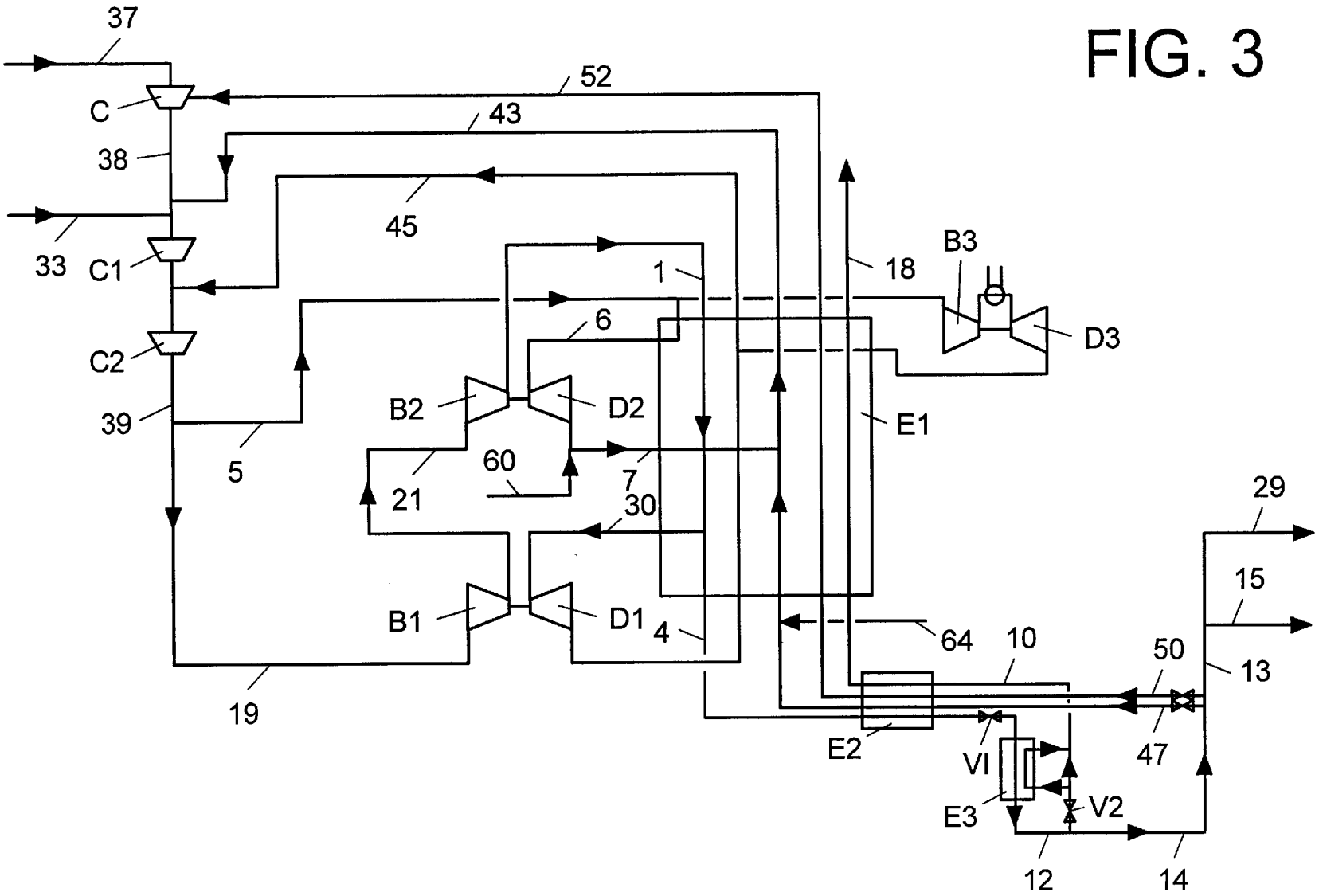
FIG. 3 is an additional embodiment of the invention wherein a portion of feed stream is first compressed, rather than cooled in the exchanger.

In FIG. 3 part of stream 5 is not cooled in exchanger E1 but is compressed in booster B3, expanded in turbine D3 coupled to the booster, warmed in exchanger E1 and recycled to compressor C2. Turbine D3 has a higher inlet temperature than turbines D1 and D2. This arrangement is useful because stream 60 is mixed with the outlet of turbine D2 and stream 61 is mixed with stream 47 upstream of exchanger E1.

Figure 4:
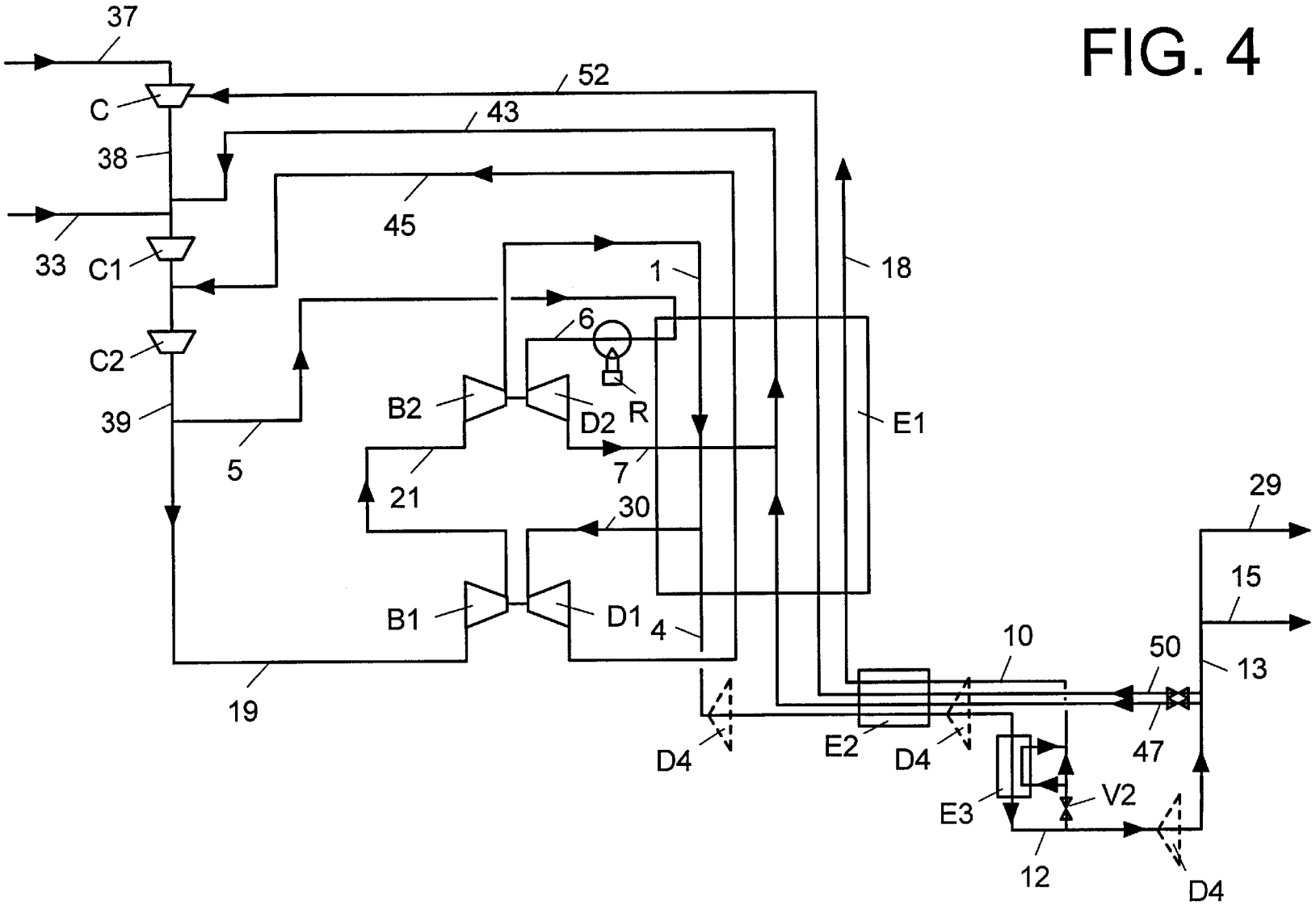
FIG. 4 is an additional embodiment of the invention wherein several alternative locations for an additional turbine are illustrated.

FIG. 4 shows several alternative positions for a turbine D4 to be fed by stream 4 which may be 100% liquid or may contain a small gaseous component. The turbine may be located between the exchangers E1 and E2, between exchangers E2 and E3, or downstream of exchanger E3.

Although the gas stream described above is nitrogen, it is clear that other gas streams could be liquefied in this way.

EXAMPLE

As denoted in FIG. 1, a stream of air is separated in an air distillation unit comprising a double column (not shown) and 4000 Nm3/h of nitrogen 33 at a first pressure of 5.1 bar abs is removed from the medium pressure column of the double column. At the same time a stream 37 of 13268 Nm3/h nitrogen at 1.1 bar abs is removed from the low pressure column of the double column; after compression in compressor C this stream 38 is mixed with the nitrogen 33 at the first pressure and 31494 Nm3/h of a first recycle stream 43.

The stream is then compressed to a second pressure of 8.79 bars abs date in compressor C1 (first compression means) and is mixed with a second recycle stream 45 of 54100 Nm3/h; the total stream of 104150 Nm3/h is compressed in compressor C2 (second compression means) to a third pressure of 28.75 bar abs to form stream 39 and is divided in two.

A first stream 19 of 74450 Nm3/h is further compressed in boosters B1, B2 to 49.69 bars abs, is cooled to −108° C. in heat exchanger E1 and is divided in two. Booster B1 is coupled to first turbine D1 and booster B2 is coupled to second turbine D2.

Part 30 of the first stream (54100 Nm3/h) is expanded by the first turbine D1 to the intermediate pressure of 9 bar abs, is warmed in the heat exchanger E1 and is mixed with the feed stream upstream of compressor C1 forming the second recycle stream 45. The rest 4 of the first portion (20350 Nm3/h) is liquefied in heat exchanger E1, sent to heat exchanger E2 where it is cooled from −169° C. to −186° C., expanded in valve V1, cooled to −194° C. in heat exchanger E3 and divided in two fractions.

The first fraction 14 is divided into three streams 13, 47, and 50, two of which return to heat exchanger E1. Following warming to ambient temperature, wherein ambient temperature is defined to be between about −50° C. to about 50° C., preferably between about −20° C. to about 45° C., and most preferably between about 0° C. to about 40° C., stream 47 (1794 Nm3/h) is mixed with the first recycle stream 7 within the heat exchanger E1 and stream 50, 52 (1288 Nm3/h) is recycled to compressor C and is mixed with the low pressure nitrogen.

The rest 13 of the first fraction (15283 Nm3/h) is divided into two substreams, one of which 29 is sent back to the air separation unit, the other 15 being sent to a storage tank.

The second fraction is expanded in valve V2 and separated into a gas stream and a liquid stream which is sent back to heat exchanger E3. The two streams are then mixed, sent to heat exchangers E2 and E1 and then vented (1985 Nm3/h) (streams 10 and 18).

The second portion 5 is slightly cooled to 7° C., passes through refrigeration unit R where it is cooled to −25° C. and is expanded to 5.24 bars abs in second turbine D2. It is then warmed and mixed with the stream 47 and then with feed stream 38 downstream of compressor C1.

The present invention has been described with reference to several specific embodiments thereof. These embodiments should not be viewed as a limitation on the scope of the present invention; such scope should be ascertained by the following claims.

What is claimed is:

1. Process for liquefying a gas stream comprising:

(a) compressing a first gas stream from a first pressure to a second pressure;

(b) compressing said first gas stream from said second pressure to a third pressure;

(c) dividing said first compressed gas stream at said third pressure into first and second portions;

(d) compressing said first portion, cooling said compressed first portion, expanding part of said compressed first portion in a first turbine and at least partially liquefying the rest of said first portion to form an at least partially liquefied fraction;

(e) cooling at least part of said second portion and expanding said at least part of said cooled second portion in a second turbine, said second turbine having a higher inlet temperature than said first turbine wherein said first turbine has an outlet pressure different from the outlet pressure of said second turbine.

2. The process of claim 1 wherein the outlet pressure of the first turbine is higher than the outlet pressure of the second turbine.

3. The process of claim 1 wherein the outlet pressure of the second turbine is substantially equal to the first pressure.

4. The process of claim 3 wherein the outlet pressure of the first turbine is higher than the outlet pressure of the second turbine.

5. The process of claim 1 wherein the outlet pressure of the first turbine is substantially equal to said second pressure.

6. The process of claim 1 wherein said first portion is compressed by two boosters in series, each coupled to one of said first and second turbines.

7. The process of claim 1 wherein at least part of said expanded second portion is recycled to said first gas stream.

8. The process of claim 1 wherein at least part of said expanded first portion is recycled to said compressed first gas stream at said second pressure.

9. The process of claim 1 wherein the outlet pressure of the second turbine is in the range of about 4 to about 10 bar abs.

10. The process of claim 1 wherein the inlet pressure of the first turbine is in the range of about 40 to about 80 bar abs.

11. The process of claim 1 wherein the outlet pressure of the first turbine is in the range of about 5 to about 15 bar abs.

12. The process of claim 1 in which at least a portion of said second portion passes through a refrigeration unit.

13. The process of claim 1 in which said first compressed gas stream at said third pressure is divided into said first portion, said second portion and a third portion, said third portion being cooled and expanded in a third turbine at an inlet temperature higher than that of one of said first and second turbines.

14. The process of claim 1 in which said first compressed gas stream at said third pressure is divided into said first portion, said second portion and a third portion, said third portion being cooled and expanded in a third turbine at an inlet temperature higher than that of one of said first and second turbines.

15. The process of claim 1 in which the liquefied part of the first portion is subcooled to form a subcooled liquid by indirect heat exchange with a portion of said subcooled liquid after expansion at a pressure lower than the outlet pressure of the first turbine.

16. The process of claims 1 to 15 in which gaseous stream at different level of temperature are fed from an air separation unit to the said liquefier.

17. The process of claim 1 wherein said at least partially liquefied portion is sent at least in part to an expansion device.

18. Liquefier for liquefying a gas stream comprising:

(a) a heat exchanger;

(b) first and second turbines;

(c) first compression device;

(d) second compression device;

(e) third compression device;

(f) a conduit for sending said gas stream to said first compression device;

(g) a conduit for sending said gas stream from said first compression device to said second compression device;

(h) conduits for dividing said gas stream compressed by said second compression device into first and second portions, for sending said first portion to said third compression device and for sending said first portion from said third compression device to said heat exchanger;

(i) a conduit for sending part of said first portion from said heat exchanger to said first turbine, a conduit for sending said part of said first portion from said first turbine to said second compression device;

(j) a conduit for at least partially liquefying rest of said first portion to form an at least partially liquefied fraction;

(k) a conduit for sending at least part of said second portion from said second compression means to said heat exchanger;

(l) a conduit for sending said at least part of said second portion from said heat exchanger to said second turbine; and (m) a conduit for sending said second portion from said second turbine to said first compression device.

19. The liquefier of claim 18 wherein said third compression device is comprised by two boosters in series.

20. The liquefier of claim 18 comprising an expansion device for expanding at least part of ssaid at least partially liquefied fraction.

21. The liquefier of claim 18 comprising an expansion device for expanding at least part of said at least partially liquefied fraction.

* * * * *